United States Patent [19]

Davis

[11] 4,106,598

[45] Aug. 15, 1978

[54] COMPARTMENTAL LUGGAGE CASE AND METHOD OF MAKING

[75] Inventor: Michael Davis, New Castle, Pa.

[73] Assignee: Airway Industries, Inc., Ellwood City, Pa.

[21] Appl. No.: 831,112

[22] Filed: Sep. 7, 1977

[51] Int. Cl.[2] ..... A45C 13/02

[52] U.S. Cl. ..... 190/52; 150/30; 190/54

[58] Field of Search ..... 220/22; 229/4.5, 21; 190/24, 25, 35, 4 C, 48, 51, 52, 54; 150/30, 36

[56] References Cited

U.S. PATENT DOCUMENTS

| | | | |
|---|---|---|---|
| 1,198,596 | 9/1916 | Strange | 229/4.5 |
| 1,490,001 | 4/1924 | Gaynor | 190/51 |
| 2,131,583 | 9/1936 | Crotty et al. | 190/52 |
| 2,196,689 | 4/1940 | Wolf | 220/22 |
| 2,379,126 | 6/1945 | Welden | 220/22 |
| 2,531,302 | 11/1950 | Schwennicke | 190/50 |
| 2,738,041 | 3/1956 | Haes | 190/51 |
| 3,292,747 | 12/1966 | Dawson | 190/51 |
| 3,848,795 | 11/1974 | Bird et al. | 229/4.5 |
| 4,055,239 | 10/1977 | Weiner | 190/50 |

FOREIGN PATENT DOCUMENTS

| | | | |
|---|---|---|---|
| 595,348 | 7/1958 | Italy | 150/30 |
| 397,567 | 8/1933 | United Kingdom | 190/50 |

*Primary Examiner*—William Price
*Assistant Examiner*—Bruce H. Bernstein
*Attorney, Agent, or Firm*—Buell, Blenko & Ziesenheim

[57] ABSTRACT

A luggage case having two compartments respectively accessible from opposite sides of the case. The two compartments are formed by means of a partition yieldably retained intermediately of the opposite sides of the frame of the case by elasticized fabric attached to the partition and stretched over the side edges of the frame, which fabric at the same time provides an internal lining for the luggage case of pleasing appearance.

3 Claims, 4 Drawing Figures

COMPARTMENTAL LUGGAGE CASE AND METHOD OF MAKING

This invention relates to luggage cases of the light-weight soft-sided type with semi-rigid frame, and especially to such luggage cases of the compartmental type having two compartments respectively accessible from opposite sides of the luggage case through hinged covers.

Luggage cases are known that are divided into two compartments respectively accessible from opposite sides of the case. Such compartments are usually formed by means of a partition, which is mechanically attached to or forms a part of the frame structure of the luggage case.

Insofar as manufacture is concerned, the attachment of a partition in a rigid framework of a luggage case makes for a relatively complicated operation and increases the cost of the luggage case substantially relative to the cost of a luggage case with a single compartment.

It is, therefore, the object of my invention to provide a two compartment luggage case of the semi-rigid soft-sided type which has a partition intermediate the opposite side of the case which is readily and simply attached to the frame of the case.

Moreover, I provide a method of installation of a partition for compartmentalizing a luggage case which requires less effort and which is lower in labor cost of installation than that involved in any luggage case heretofore known.

The above and other novel aspects of my invention will be made clear in the following more detailed description thereof when read in connection with the accompanying drawings, wherein.

Figure 1:
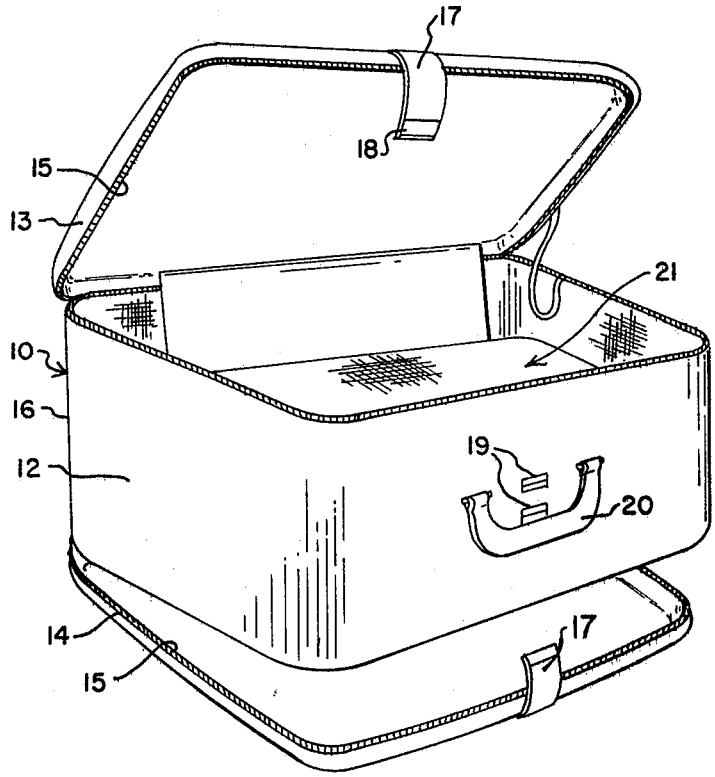
FIG. 1 is a view showing a two-compartment luggage case embodying my invention, with the two hinged lids or side covers shown in partly open position.
Figure 2:
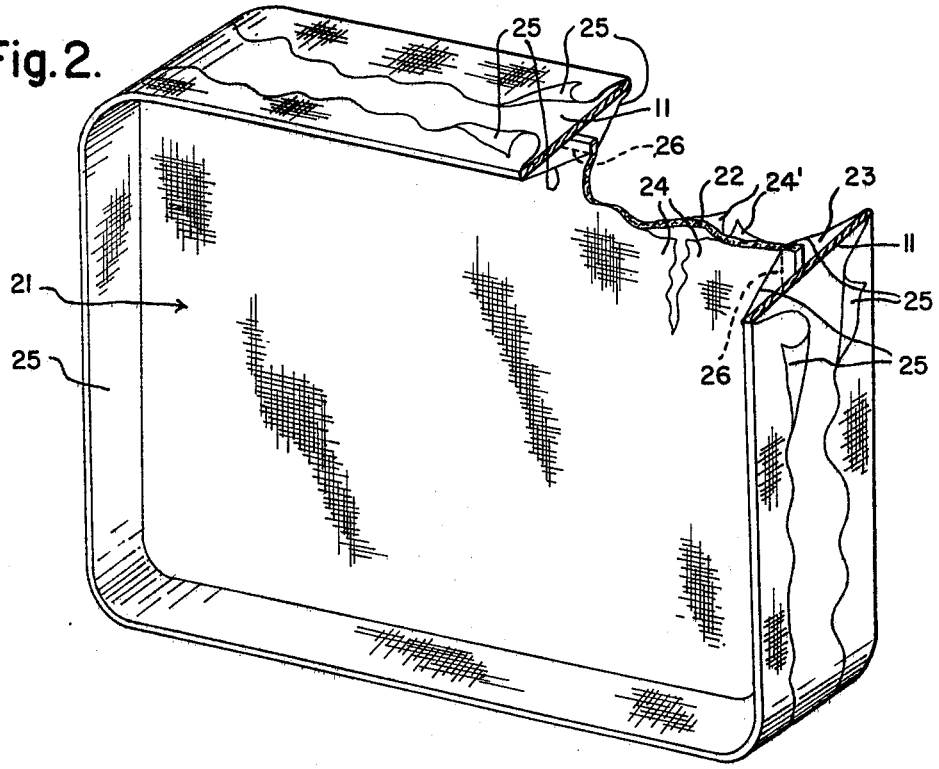
FIG. 2 is a perspective view with a corner fragment broken away, showing illustratively a laminated plywood frame of a luggage case and a partition attached centrally therein.

Referring to FIGS. 1 and 2 of the drawings, a luggage case 10 is shown having a light-weight frame 11 formed of wood or laminated plywood for example, on which is provided a covering 12 of a suitable fabric or plastic material, and closed at opposite sides by hinged lids 13 and 14 of the same or different covering material for respectively closing opposite sides of the luggage case. By way of example only, the fabric covering 12 for the lids and the body portion 16 are provided with separable slide fasteners 15 for locking the lids to the central body portion 16 of the case. The slide members and tabs are omitted in the drawings as they are conventional. Also, by way of example, each of the hinged lids 13 and 14 has a locking tongue 17 with a latch 18 at its distal end for engaging in a corresponding one of two locks 19 attached to the body portion 16 of the case. A handle 20 is suitably pivotally attached to the body portion of the case, substantially in straddling relation to the locks 19.

Figure 3:
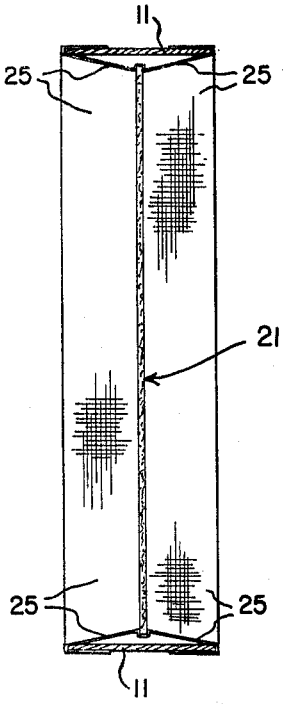
FIG. 3 is a transverse sectional view through the plywood frame and partition of FIG. 2.
Figure 4:
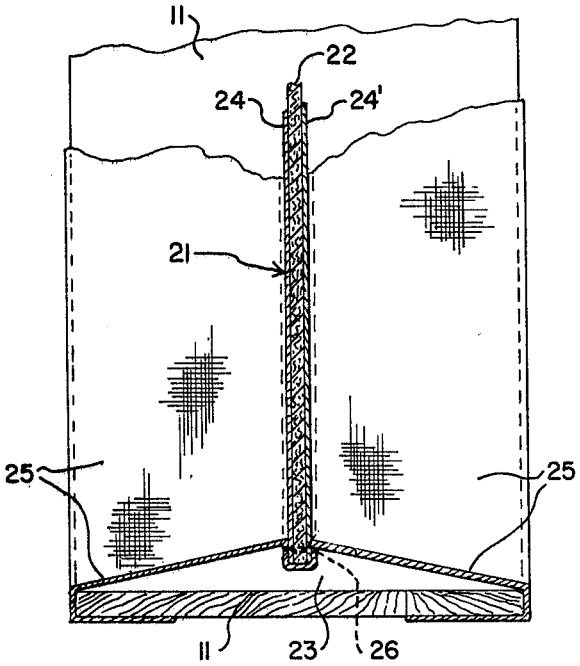
FIG. 4 is an enlarged fragmental sectional view, showing in further detail the manner of attachment of the partition to the laminated plywood frame.

Referring now to FIGS. 2, 3 and 4, the construction and manner of installation of the dividing partition 21 will now be described.

The partition 21 is made up of a semi-rigid board 22 of fibrous material for example, having an area smaller than the projected area of the side opening of the laminated plywood frame, and rounded at the four corners. It will be noted that side edges of the partition board 22 have a substantial clearance at 23 (FIG. 2) with respect to the interior surface of the wall of the laminated frame 11.

As seen particularly in FIG. 4, the board 22 is covered on opposite sides with separate layers of fabric material 24, 24′ which may also be elasticized fabric material. Board 22 is preferably cut out of a large sheet of fibrous material on which the fabric material 24, 24′ is first stretched tautly and glued to opposite sides. After the board 22, with fabric material covering both sides, is cut out of the sheet, a wide strip 25 of elasticized fabric material is placed around the edges of the board 22 and then, while folded back to opposite sides, fastened closely adjacent to the periphery of the board 22 as by stitching at 26 through the strip 25, fabric layers 24 and 24′ and the board 22.

The partition 21 is now installed within the frame 11, by supporting it in a horizontal position centrally of the frame, as by using suitable blocks placed under it. One side of the strip 25 is now stretched tautly over the upper side edge of the frame 11 and the outer area thereof is then glued to the outer peripheral surface of the frame. The frame is then turned over, and the partition again supported, as by blocks. The other side of strip 25 is then stretched tautly over the upper side edge of the frame and glued to the outer peripheral surface of the frame, as seen in FIGS. 2 and 4.

Following the installation of the partition 21 in the frame 11, as just described, the fabric covering 12 may by applied conventionally to the body portion 16 and to the lids 13 and 14. Also the locks 19, handle 20 and locking tongues 17 are applied in well known manner. It will be understood that the slide fasteners 15 are attached to the fabric covering 12 for both the body portion 16 and for the lids 13 and 14 before the covering is applied.

It will be seen that my invention provides a partition for a compartmental luggage case which yields slightly to pressure of loading on opposite sides by reason of the elasticized mounting strip 25. It will be apparent, also, that I have provided a novel method of installing a partition intermediate the sides of a luggage case, wherein the fabric material 25 which attaches the partition, to the frame 11 also serves as the lining for the interior of the case.

While I have described a preferred embodiment of my invention with specific means for making and a specific method for installing a partition in the luggage frame intermediate the sides of the luggage case, it will be apparent that modifications may be made in both the means and the steps of the method without departing from the invention as herein defined in the appended claims.

I claim:

1. In a luggage case of the compartmental type having a substantially rectangular frame of formed wood and two compartments therein respectively accessible from opposite sides of the frame, the improvement comprising a partition member of a semi-rigid sheet material smaller in area than the projected area of said frame and so disposed intermediate the opposite edges of said frame as to provide top and bottom sides, and a strip of elasticized fabric means in a closed loop completely surrounding and attached to the peripheral edge of the said partition member, said fabric means being stretched tautly in opposite directions from the partition member over the side edges of the said frame and attached to the outer surface of the said frame.

2. In a luggage case of the compartmental type according to claim 1, wherein said elasticized fabric means constitutes that part of the interior lining of said case between the top and bottom sides of said partition member and the opposite peripheral edges of said frame.

3. In a luggage case of the compartmental type according to claim 1, wherein sheets of elasticized fabric material are tautly stretched and respectively adhesively secured to the top and bottom sides of the partition member to constitute a part of the interior lining of said case.

* * * * *